US009113520B2

(12) United States Patent
Lin

(10) Patent No.: US 9,113,520 B2
(45) Date of Patent: Aug. 18, 2015

(54) LIGHT EMITTING DIODE BACKLIGHT SYSTEM THE DRIVING APPARATUS AND DRIVING METHOD THEREOF

(71) Applicant: Power Forest Technology Corporation, Hsinchu (TW)

(72) Inventor: Hsiu-Ping Lin, Hsinchu County (TW)

(73) Assignee: Power Forest Technology Corporation, Hsinchu County (TW)

( * ) Notice: Subject to any disclaimer, the term of this patent is extended or adjusted under 35 U.S.C. 154(b) by 287 days.

(21) Appl. No.: 13/831,718

(22) Filed: Mar. 15, 2013

(65) Prior Publication Data

US 2014/0167630 A1 Jun. 19, 2014

(30) Foreign Application Priority Data

Dec. 17, 2012 (TW) ..... 101147916 A

(51) Int. Cl.

| | |
|---|---|
| ***H05B 37/00*** | (2006.01) |
| ***H05B 39/00*** | (2006.01) |
| ***H05B 41/00*** | (2006.01) |
| ***H05B 33/08*** | (2006.01) |

(52) U.S. Cl.

CPC ..... *H05B 33/0815* (2013.01); *H05B 33/0827* (2013.01); *H05B 33/0845* (2013.01)

(58) Field of Classification Search

USPC ..... 315/186, 210

See application file for complete search history.

(56) References Cited

U.S. PATENT DOCUMENTS

| | | | | |
|---|---|---|---|---|
| 8,786,341 | B1 * | 7/2014 | Weltin-Wu et al. | 327/159 |
| 2002/0044620 | A1 * | 4/2002 | Spijker et al. | 375/371 |
| 2009/0225020 | A1 | 9/2009 | Ran et al. | |
| 2013/0063042 | A1 * | 3/2013 | Bora et al. | 315/292 |
| 2013/0249611 | A1 * | 9/2013 | Vandepas | 327/159 |
| 2014/0002288 | A1 * | 1/2014 | Scholz | 341/144 |
| 2014/0266354 | A1 * | 9/2014 | Boo et al. | 327/159 |
| 2014/0333358 | A1 * | 11/2014 | Kim et al. | 327/159 |
| 2014/0368242 | A1 * | 12/2014 | Unruh | 327/156 |
| 2015/0008961 | A1 * | 1/2015 | Kim et al. | 327/12 |
| 2015/0116018 | A1 * | 4/2015 | Chen et al. | 327/159 |

FOREIGN PATENT DOCUMENTS

| | | |
|---|---|---|
| TW | 201117661 | 5/2011 |
| TW | M417740 | 12/2011 |
| TW | 201208463 | 2/2012 |

OTHER PUBLICATIONS

"Office Action of Taiwan Counterpart Application", issued on Sep. 24, 2014, p. 1-p. 12.

* cited by examiner

*Primary Examiner* — Adam Houston

(74) *Attorney, Agent, or Firm* — Jianq Chyun IP Office

(57) ABSTRACT

A light emitting diode (LED) backlight system and a driving apparatus and a driving method thereof are provided. The driving apparatus is suitable for an LED backlight system with N LED strings, where N is a positive integer greater than 1, and which includes an LED driver and a switching unit. The LED driver is configured to receive a dimming signal and time-divisionally generate N control signals in response to a counting clock and an enabling time and a period time both related to the dimming signal. The switching unit is coupled to the LED driver and the N LED strings, and is configured to respectively control an on-off time ratio of a current flowing through each of the LED strings in response to the N control signals.

16 Claims, 5 Drawing Sheets

LIGHT EMITTING DIODE BACKLIGHT SYSTEM THE DRIVING APPARATUS AND DRIVING METHOD THEREOF

CROSS-REFERENCE TO RELATED APPLICATION

This application claims the priority benefit of Taiwan application serial no. 101147916, filed on Dec. 17, 2012. The entirety of the above-mentioned patent application is hereby incorporated by reference herein and made a part of this specification.

TECHNICAL FIELD

The invention relates to a light emitting diode (LED) driving technology, and more particularly, to an LED backlight system with a driving apparatus and a driving method thereof.

BACKGROUND

In recent years, with the advancement of semiconductor technologies, portable electronic products and flat panel displays are developed rapidly. Among various flat panel displays, liquid crystal displays (LCDs) free of harmful radiation and characterized by low operating voltage, light weight, and small volume have become the mainstream display products of the market. Generally speaking, since the LCD panel has no luminescent function itself, a backlight module is required to be disposed under the LCD panel, so as to provide a backlight source to the LCD panel.

The conventional backlight modules are broadly divided into cold cathode fluorescent lamp (CCFL) backlight modules and light emitting diode (LED) backlight modules, in which the LED backlight module can improve a color gamut of the LCD, and thus the current panel manufacturers generally employ the LED backlight modules to replace the CCFL backlight modules.

The LED backlight module has a plurality of LED strings arranged in parallel, and each of the LED strings is composed of a plurality of LEDs connected in series. In an actual application, all the LED strings can be operated under a system voltage (VBUS) generated by a boost unit, so as to maintain the same constant current for the current flowing through each of the LED strings.

On the other hand, in some applications, there might be requirements for adjusting brightness because of being cooperated with ambient light or the displayed frames being different. At this current stage, the most commonly used method is to provide a dimming signal in order to simultaneously control an on-off time ratio of the current flowing through each of the LED strings and to achieve the purpose of dimming through using persistence of vision. However, such method causes the momentary load of the boost unit for providing the system voltage (VBUS) to be intensified when the provided dimming signal is enabled, and there will be no load existed when the dimming signal is disabled. By this way, the following three issues are derived:

1. the ripple of the system voltage (VBUS) provided by the boost unit will be increased, thereby causing the instability of the current flowing through each of the LED strings;

2. the voltage conversion ratio of the boost unit is deteriorated in response to the intensified momentary load of the boost unit; and 3. the phenomenon of higher electromagnetic interference (EMI) will be occurred in response to the large current caused by the intensified momentary load of the boost unit.

SUMMARY

Accordingly, the invention is directed to an LED backlight system with a driving apparatus and a driving method thereof, so as to solve the problems of the prior art.

In an exemplary embodiment of the invention, a driving apparatus of a light emitting diode (LED) backlight system is provided, in which the LED backlight system has N LED strings, where N is a positive integer greater than 1, and the driving apparatus includes an LED driver and a switching unit. The LED driver is configured to receive a dimming signal and time-divisionally generate N control signals in response to a counting clock and an enabling time and a period time both related to the dimming signal. The switching unit is coupled to the LED driver and the N LED strings, and is configured to respectively control an on-off time ratio of a current flowing through each of the LED strings in response to the N control signals.

In an exemplary embodiment of the invention, the LED driver includes a first counter, a divider, a pulse signal generator and N second counters. The first counter is configured to receive the dimming signal and count the dimming signal in response to the counting clock so as to obtain an enabling counting value and a period counting value that respectively represent the enabling time and the period time of the dimming signal, in which a frequency of the counting clock is substantially greater than a frequency of the dimming signal. The divider is coupled to the first counter, and is configured to divide the period counting value by N so as to obtain a delay value. The pulse signal generator is coupled to the divider, and is configured to time-divisionally generate N pulse signals within the period time of the dimming signal in response to the dimming signal, the counting clock and the delay value. The N second counters are coupled to the first counter and the pulse signal generator, and are configured to time-divisionally generate N control signals in response to the enabling counting value, the counting clock and the N pulse signals.

In an exemplary embodiment of the invention, the switching unit includes N switches which respectively correspond to the N LED strings and respectively control the on-off time ratio of the current flowing through each of the LED strings in response to the N control signals.

In an exemplary embodiment of the invention, the N LED strings are operated under a same system voltage. Under the condition, the driving apparatus further includes a boost-buck unit which is configured to receive a direct-current (DC) input voltage and perform a boost-buck process on the DC input voltage by employing a pulse width modulation (PWM) control mechanism so as to generate and output the system voltage.

In an exemplary embodiment of the invention, the boost-buck unit further steadily outputs the system voltage in response to a feedback voltage from the LED driver.

In another exemplary embodiment of the invention, an LED backlight system is provided, which includes N LED strings and a driving apparatus, where N is a positive integer greater than 1. The driving apparatus is coupled to the N LED strings, and is configured to receive a dimming signal and time-divisionally generate N control signals in response to a counting clock and an enabling time and a period time both related to the dimming signal. Moreover, the driving apparatus further respectively controls an on-off time ratio of a current flowing through each of the LED strings by a switching means in response to the N control signals.

In an exemplary embodiment of the invention, the structure of the driving apparatus included in the LED backlight system is similar to the afore-described driving apparatus.

In yet another exemplary embodiment of the invention, a driving method of an LED backlight system is provided, in which the LED backlight system has N LED strings, where N is a positive integer greater than 1, and the driving method includes: time-divisionally generating N control signals according to a counting clock and an enabling time and a period time both related to a dimming signal; and respectively controlling an on-off time ratio of a current flowing through each of the LED strings according to the N control signals.

In an exemplary embodiment of the invention, the step of time-divisionally generating the N control signals includes: counting the dimming signal according to the counting clock, so as to obtain an enabling counting value and a period counting value that respectively represent the enabling time and the period time of the dimming signal, in which a frequency of the counting clock is substantially greater than a frequency of the dimming signal; dividing the period counting value by N so as to obtain a delay value; time-divisionally generating N pulse signals within the period time of the dimming signal according to the dimming signal, the counting clock and the delay value; and time-divisionally generating N control signals by a counting means according to the enabling counting value, the counting clock and the N pulse signals.

In an exemplary embodiment of the invention, the step of respectively controlling the on-off time ratio of the current flowing through each of the LED strings includes: respectively controlling the on-off time ratio of the current flowing through each of the LED strings by a switching means according to the N control signals.

In an exemplary embodiment of the invention, the N LED strings are operated under a same system voltage. Under the condition, before time-divisionally generating the N control signals, the driving method further includes: performing a boost-buck process on a DC input voltage by employing a PWM control mechanism so as to generate the system voltage.

In an exemplary embodiment of the invention, after generating the system voltage, the driving method further includes: causing the system voltage to be steadily outputted in response to a feedback voltage.

Based on the above, in the LED backlight system of the invention, the dimming signal for dimming the N LED strings is processed in a purely digital manner, so as to time-divisionally generate N control signals and respectively control the on-off time ratio of the current flowing through each of the LED strings by the mechanism of switching the switches. By this way, the momentary load of the boost-buck unit for providing the system voltage (VBUS) will neither be intensified when the dimming signal is enabled nor no load existed when the dimming signal is disabled. Accordingly, the aforedescribed issues from Background can be solved effectively by the invention.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the invention.

DESCRIPTION OF THE EMBODIMENTS

Figure 1:
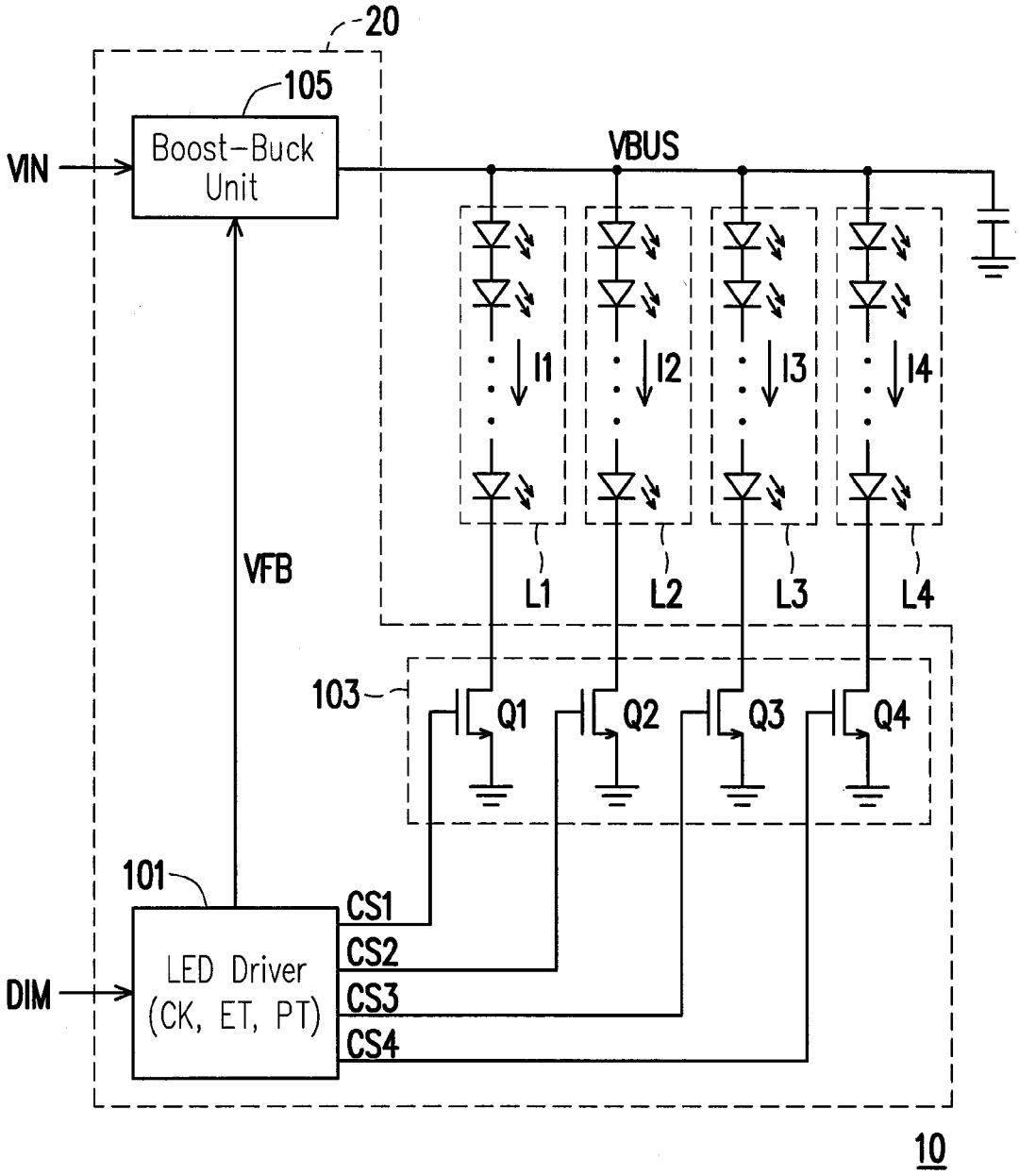
FIG. 1 is a schematic diagram illustrating a light emitting diode (LED) backlight system 10 according to an exemplary embodiment of the invention.

Descriptions of the invention are given with reference to the exemplary embodiments illustrated with accompanied drawings, wherein same or similar parts are denoted with same reference numerals. In addition, whenever possible, identical or similar reference numbers stand for identical or similar elements in the figures and the embodiments.

FIG. 1 is a schematic diagram illustrating a light emitting diode (LED) backlight system 10 according to an exemplary embodiment of the invention. Referring to FIG. 1, the LED backlight system 10 may be applied in a liquid crystal display (LCD) system, although the invention is not limited thereto. The LED backlight system 10 includes N LED strings and a driving apparatus 20. In the exemplary embodiment, N is a positive integer greater than 1, but it is assumed that N=4 for illustration purpose here. Thus, the LED backlight system 10 includes four LED strings L1~L4, and each of the LED strings L1~L4 includes a plurality of light emitting diodes forwardly connected in series.

Moreover, the driving apparatus 20 is coupled to the LED strings L1~L4, and is configured to receive a dimming signal DIM for dimming the LED strings L1~L4 and time-divisionally generate four control signals CS1~CS4 in response to a counting clock CK and an enabling time ET and a period time PT both related to the dimming signal DIM. The driving apparatus 20 may further respectively control an on-off time ratio of a current (i.e., I1~I4) flowing through each of the LED strings L1~L4 by a switching means in response to the four control signals CS1~CS4 time-divisionally generated.

In the exemplary embodiment, the driving apparatus 20 includes an LED driver 101, a switching unit 103 and a boost-buck unit 105, in which the LED driver 101 is configured to receive the dimming signal DIM for dimming the LED strings L1~L4 and time-divisionally generate the four control signals CS1~CS4 in response to the counting clock CK and the enabling time ET and the period time PT both related to the dimming signal DIM.

Figure 2:
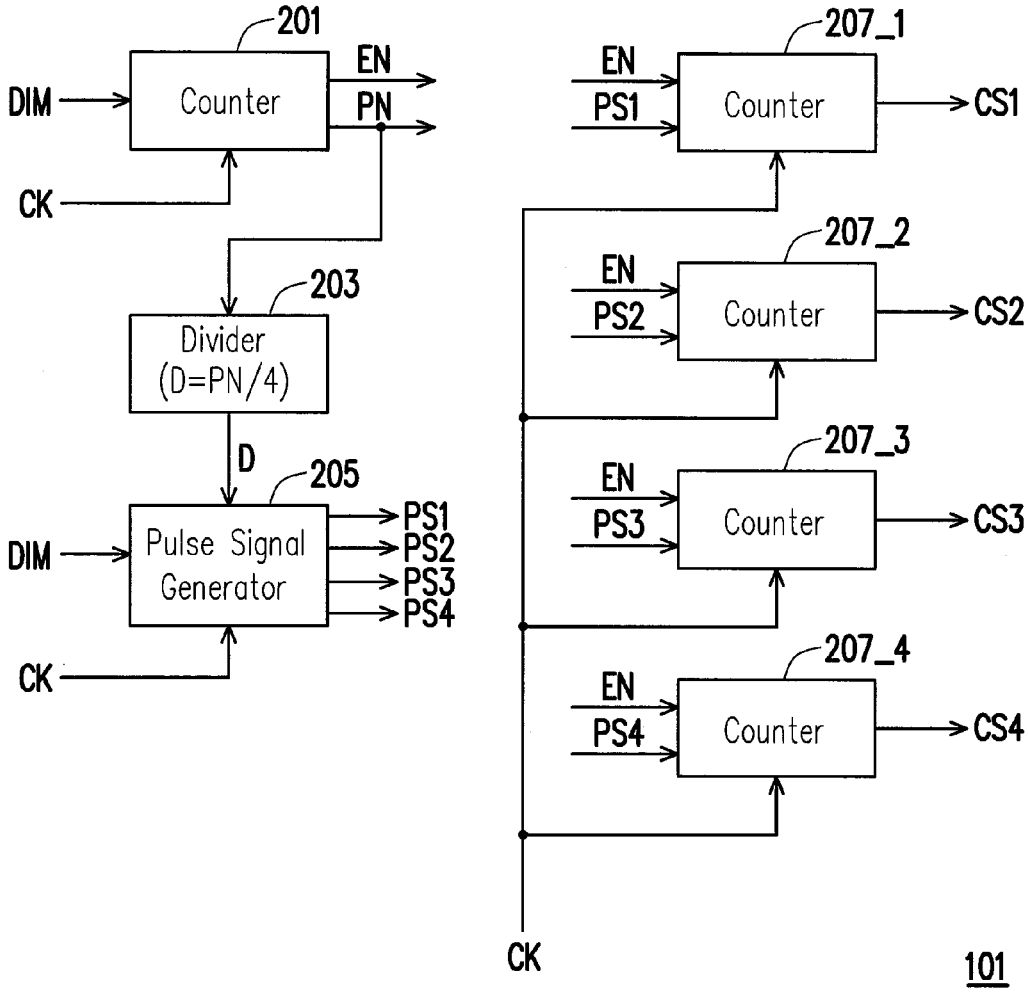
FIG. 2 is a schematic diagram illustrating an LED driver 101 depicted in FIG. 1.
Figure 3:
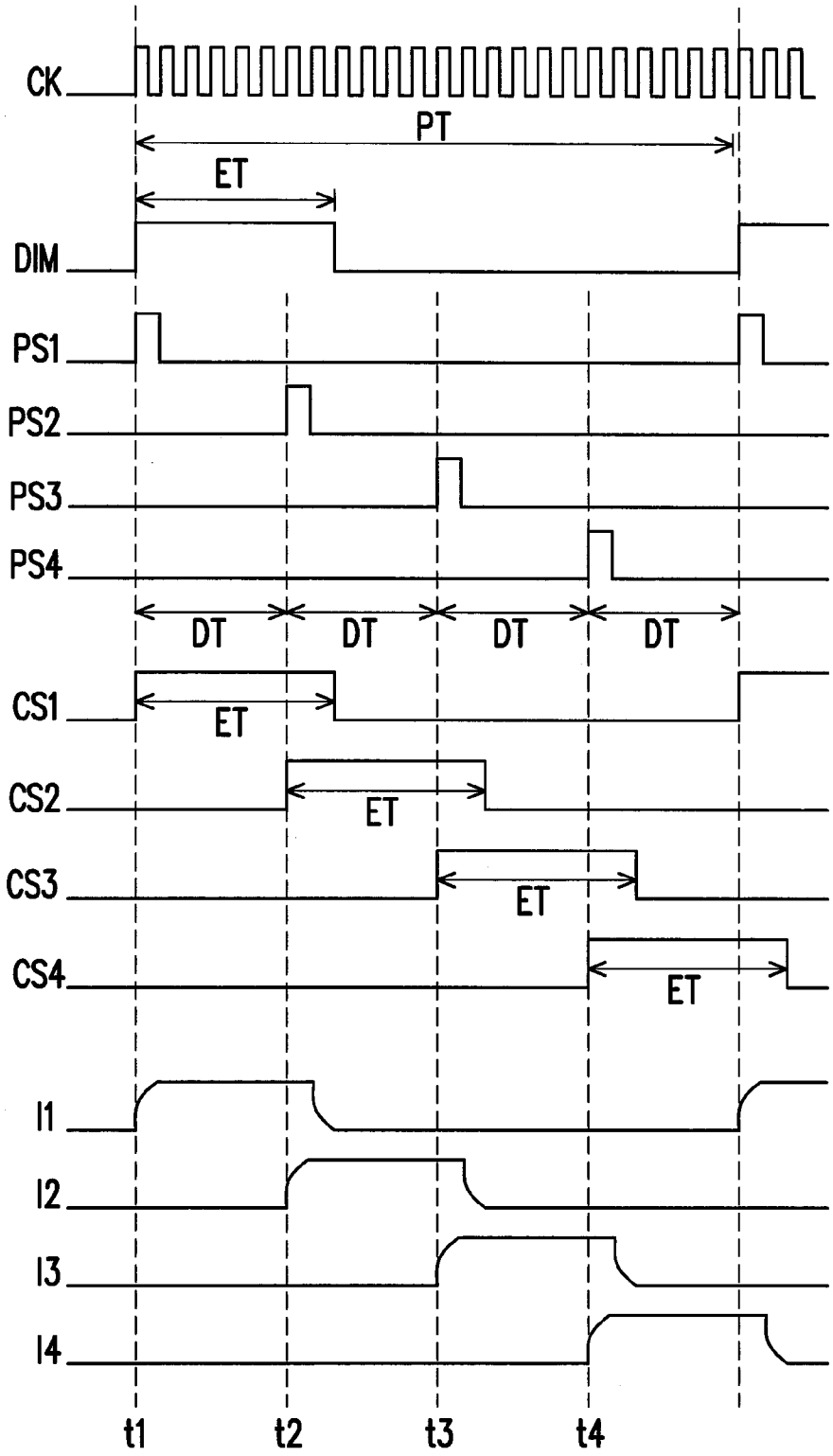
FIG. 3 is an operational timing diagram illustrating an LED driver 101 depicted in FIG. 2.

More specifically, FIG. 2 is a schematic diagram illustrating an LED driver 101 depicted in FIG. 1, and FIG. 3 is an operational timing diagram illustrating an LED driver 101 depicted in FIG. 2. Referring to FIG. 1 to FIG. 3 together, the LED driver 101 includes a first counter 201, a divider 203, a pulse signal generator 205 and four second counters 207-1~207-4, in which the first counter 201 is configured to receive the dimming signal DIM and count the dimming signal DIM in response to the counting clock CK, so as to obtain an enabling counting value EN and a period counting value PN that respectively represent the enabling time ET and the period time PT of the dimming signal DIM.

In the exemplary embodiment, a frequency of the counting clock CK (such as 500 KHz, although the invention is not limited thereto) is substantially greater than a frequency of the dimming signal DIM (such as 100~1000 Hz, although the invention is not limited thereto). Under the condition, it can be understood that the enabling counting value EN is the total number of cycles of the counting clock CK within the enabling time of the dimming signal DIM. Similarly, it can be understood that the period counting value PN is the total number of cycles of the counting clock CK within the period time of the dimming signal DIM.

The divider 203 is coupled to the first counter 201, and is configured to divide the period counting value PN (that is obtained by the first counter 201) by N (=4), so as to obtain a delay value D, namely, D=PN/4, and the delay value D corresponds to a delay time DT. The pulse signal generator 205 is coupled to the divider 203, and is configured to time-divisionally (i.e., at times t1~t4) generate four pulse signals PS1~PS4 within the period time PT of the dimming signal DIM in response to the dimming signal DIM, the counting clock CK and the delay value D.

The second counters 207-1~207-4 are coupled to the first counter 201 and the pulse signal generator 205, and are configured to time-divisionally (i.e., at times t1~t4) generate the control signals CS1~CS4 in response to the enabling counting value EN, the counting clock CK and the pulse signals PS1~PS4 obtained by the first counter 201. More specifically, the second counter 207-1 receives the enabling counting value EN obtained by the first counter 201, and utilizes the high-speed counting clock CK to begin counting at the time t1 in response to the trigger of the pulse signal PS1 generated by the pulse signal generator 205, until conforming with the enabling counting value EN. By this way, the second counter 207-1 at the time t1 will begin to generate the control signal CS1 similar to the enabling time ET of the dimming signal DIM.

Similarly, the second counter 207-2 receives the enabling counting value EN obtained by the first counter 201, and utilizes the high-speed counting clock CK to begin counting at the time t2 in response to the trigger of the pulse signal PS2 generated by the pulse signal generator 205, until conforming with the enabling counting value EN. By this way, the second counter 207-2 at the time t2 will begin to generate the control signal CS2 similar to the enabling time ET of the dimming signal DIM.

Moreover, the second counter 207-3 receives the enabling counting value EN obtained by the first counter 201, and utilizes the high-speed counting clock CK to begin counting at the time t3 in response to the trigger of the pulse signal PS3 generated by the pulse signal generator 205, until conforming with the enabling counting value EN. By this way, the second counter 207-3 at the time t3 will begin to generate the control signal CS3 similar to the enabling time ET of the dimming signal DIM.

Furthermore, the second counter 207-4 receives the enabling counting value EN obtained by the first counter 201, and utilizes the high-speed counting clock CK to begin counting at the time t4 in response to the trigger of the pulse signal PS4 generated by the pulse signal generator 205, until conforming with the enabling counting value EN. By this way, the second counter 207-4 at the time t4 will begin to generate the control signal CS4 similar to the enabling time ET of the dimming signal DIM.

On the other hand, the switching unit 103 is coupled to the LED driver 101 and the LED strings L1~L4. More specifically, the switching unit 103 is coupled between a cathode of each of the LED strings L1~L4 and a ground. In the exemplary embodiment, the switching unit 103 is configured to respectively control an on-off time ratio of a current (i.e., I1~I4) flowing through each of the LED strings L1~L4 in response to the control signals CS1~CS4 time-divisionally generated by the LED driver 101, in which the switching unit 103 includes four (N-type) switches Q1~Q4. The switches Q1~Q4 respectively correspond to the LED strings L1~L4, and respectively control the on-off time ratio of the current (i.e., I1~I4) flowing through each of the LED strings L1~L4 in response to the control signals CS1~CS4 time-divisionally generated by the LED driver 101.

Besides, in the exemplary embodiment, each of the LED strings L1~L4 can be operated under a same system voltage VBUS generated by the boost-buck unit 105. More specifically, the boost-buck unit 105 is coupled to an anode of each of the LED strings L1~L4, and is configured to receive a direct-current (DC) input voltage VIN and perform a boost-buck process on the DC input voltage VIN by employing a pulse width modulation (PWM) control mechanism so as to generate and output the system voltage VBUS. It is noted that, in order for the system voltage VBUS generated by the boost-buck unit 105 to be more stable, the LED driver 101 provides a feedback voltage VFB to control/stabilize the output of the boost-buck unit 105. In other words, the boost-buck unit 105 may further steadily output the system voltage VBUS in response to the feedback voltage VFB from the LED driver 101.

It can be seen that, the LED driver 101 of the exemplary embodiment processes the dimming signal DIM for dimming the N (=4) LED strings L1~LN in the LED backlight system 10 by the purely digital method, so as to time-divisionally generate the N (=4) control signals CS1~CS4 and respectively control the on-off time ratio of the current flowing through each of the LED strings L1~L4 by the mechanism of switching the switches (that is, by the switching unit 103). By this way, the momentary load of the boost-buck unit 105 for providing the system voltage VBUS will neither be intensified when the dimming signal DIM is enabled nor no load existed when the dimming signal DIM is disabled. Accordingly, the LED driver 101 of the exemplary embodiment can be effectively solved the afore-described issues from Background of the invention.

Certainly, although taking the driving apparatus 20 respectively controls the on-off time ratios of the currents I1~I4 flowing through the N (=4) LED strings L1~L4 as an example in the afore-described exemplary embodiments for illustration purpose, those skilled in the art can infer or deduce themselves other modified implementations (where N is not four) according to the taught or disclosed content of the afore-described exemplary embodiments, and thus detailed description thereof will be omitted.

Figure 4:
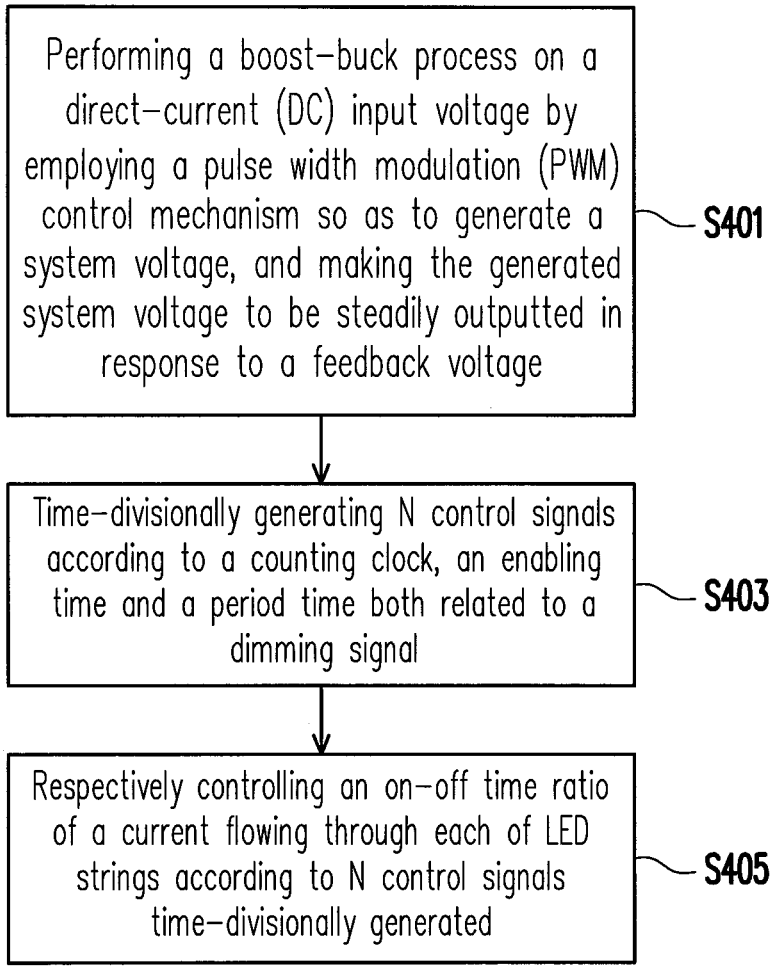
FIG. 4 is a flowchart diagram illustrating a driving method for an LED backlight system according to an exemplary embodiment of the invention.

Based on the taught or disclosed content of the afore-described exemplary embodiments, FIG. 4 is a flowchart diagram illustrating a driving method for an LED backlight system according to an exemplary embodiment of the invention. Referring to FIG. 4, the driving method of the exemplary embodiment is applicable to an LED backlight system with N LED strings, where N is a positive integer greater than 1. The driving method includes the following steps.

In step S401, a boost-buck process is performed on a DC input voltage by employing the PWM control mechanism so as to generate a system voltage, and the generated system voltage is made to be steadily outputted in response to a feedback voltage, in which all the LED strings can be operated under the same system voltage.

In step S403, N control signals are time-divisionally generated according to a counting clock and an enabling time and a period time both related to a dimming signal.

Moreover, in step S405, an on-off time ratio of a current flowing through each of the LED strings is respectively controlled according to the N control signals time-divisionally generated.

Figure 5:
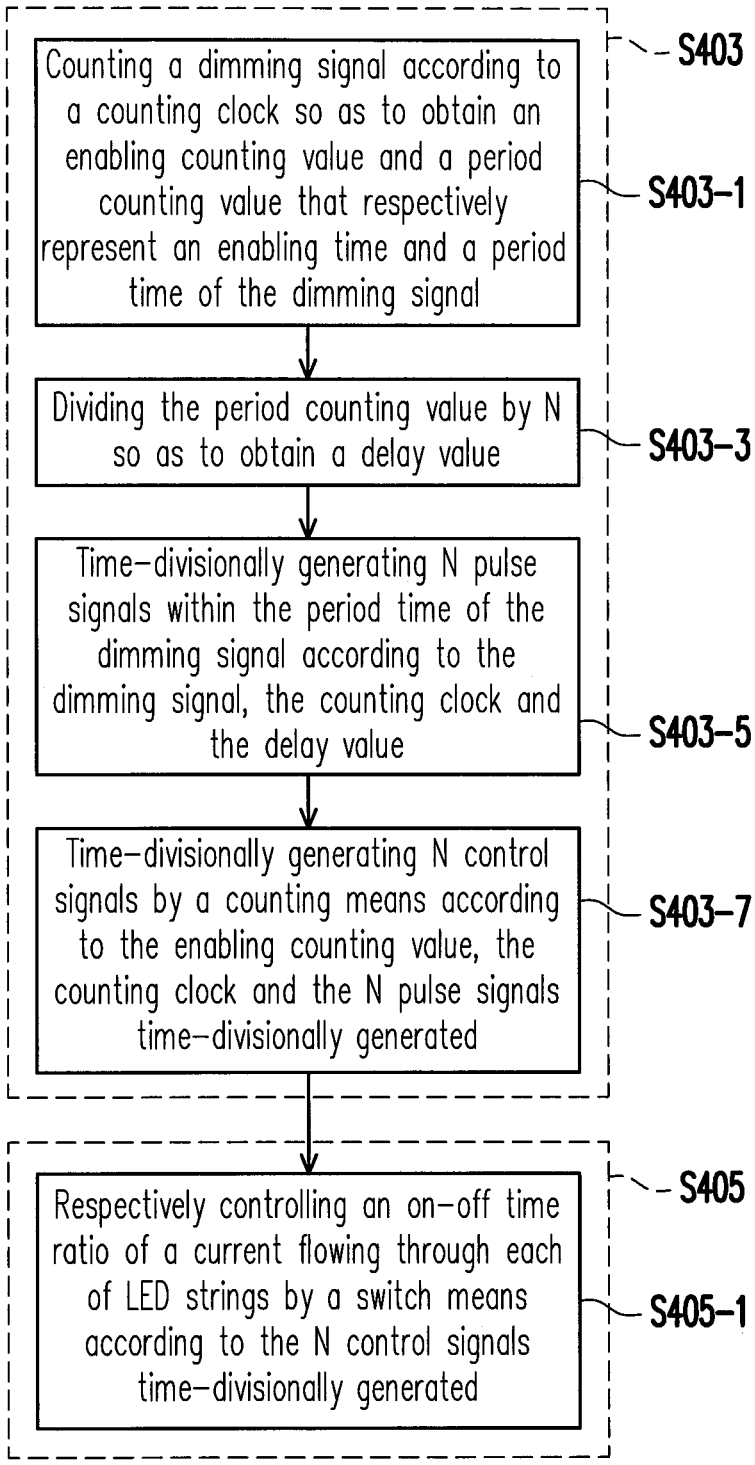
FIG. 5 is a flowchart diagram illustrating implementations of time-divisionally generating control signals and controlling an on-off time ratio of a current flowing through each of the LED strings depicted in FIG. 4.

In the exemplary embodiment, as shown in FIG. 5, the step of time-divisionally generating the N control signals can include the following sub-steps.

In step S403-1, the dimming signal is counted according to the counting clock, so as to obtain an enabling counting value and a period counting value that respectively represent the enabling time and the period time of the dimming signal, in which the frequency of the counting clock is substantially greater than the frequency of the dimming signal.

In step S403-3, the period counting value is divided by N so as to obtain a delay value.

In step S403-5, N pulse signals are time-divisionally generated within the period time of the dimming signal according to the dimming signal, the counting clock and the delay value.

Moreover, in step S403-7, the N control signals are time-divisionally generated by a counting means according to the enabling counting value, the counting clock and the N pulse signals time-divisionally generated.

Moreover, in the exemplary embodiment, as shown in FIG. 5, the step of respectively controlling the on-off time ratio of the current flowing through each of the LED strings can include the following sub-steps.

In step S405-1, the on-off time ratio of the current flowing through each of the LED strings is respectively controlled by a switching means according to the N control signals time-divisionally generated.

To sum up, in the LED backlight system of the invention, the dimming signal for dimming the N LED strings is processed in a purely digital manner, so as to time-divisionally generate N control signals and respectively control the on-off time ratio of the current flowing through each of the LED strings by the mechanism of switching the switches. By this way, the momentary load of the boost-buck unit for providing the system voltage (VBUS) will neither be intensified when the dimming signal is enabled nor no load existed when the dimming signal is disabled. Accordingly, the afore-described issues from Background can be solved effectively by the invention.

Besides, although taking the driving apparatus is applied in the liquid crystal display system as an example in the afore-described exemplary embodiments for illustration purpose, the driving apparatus of the exemplary embodiments is applicable to any systems with the backlight or illumination requirement (such as an advertising billboard system, a light-source supply system etc.), and thus the applying range and filed of the driving apparatus of the exemplary embodiments are not limited thereto.

It will be apparent to those skilled in the art that the descriptions above are several preferred embodiments of the invention only, which does not limit the implementing range of the invention. Various modifications and variations can be made to the structure of the invention without departing from the scope or spirit of the invention. The claim scope of the invention is defined by the claims hereinafter. Moreover, the abstract of the invention is provided to comply with the rules requiring an abstract, which will allow a searcher to quickly ascertain the subject matter of the technical disclosure of any patent issued from this invention. It is submitted with the understanding that it will not be used to interpret or limit the scope or meaning of the claims. Any advantages and benefits described may not apply to all embodiments of the invention.

What is claimed is:

1. A driving apparatus of a light emitting diode (LED) backlight system, wherein the LED backlight system has N LED strings, where N is a positive integer greater than 1, and the driving apparatus comprising:

an LED driver, configured to receive a dimming signal and time-divisionally generate N control signals by means of purely digital manner in response to a counting clock and an enabling time and a period time both related to the dimming signal, wherein enabling times of the time-divisionally generated N control signals are partially overlapped from each other; and a switching unit, coupled to the LED driver and the LED strings, and configured to respectively control an on-off time ratio of a current flowing through each of the LED strings in response to the control signals.

2. The driving apparatus of the LED backlight system according to claim 1, wherein the LED driver comprises:

a first counter, configured to receive the dimming signal and count the dimming signal in response to the counting clock so as to obtain an enabling counting value and a period counting value that respectively represent the enabling time and the period time, wherein a frequency of the counting clock is substantially greater than a frequency of the dimming signal;

a divider, coupled to the first counter, and configured to divide the period counting value by N so as to obtain a delay value;

a pulse signal generator, coupled to the divider, and configured to time-divisionally generate N pulse signals within the period time of the dimming signal in response to the dimming signal, the counting clock and the delay value; and N second counters, coupled to the first counter and the pulse signal generator, and configured to time-divisionally generate the control signals in response to the enabling counting value, the counting clock and the pulse signals.

3. The driving apparatus of the LED backlight system according to claim 1, wherein the switching unit comprises:

N switches, respectively corresponding to the LED strings and respectively controlling the on-off time ratio of the current flowing through each of the LED strings in response to the control signals.

4. The driving apparatus of the LED backlight system according to claim 1, wherein the LED strings are operated under a same system voltage, and the driving apparatus further comprises:

a boost-buck unit, configured to receive a direct-current (DC) input voltage and perform a boost-buck process on the DC input voltage by employing a pulse width modulation (PWM) control mechanism so as to generate and output the system voltage.

5. The driving apparatus of the LED backlight system according to claim 4, wherein the boost-buck unit further steadily outputs the system voltage in response to a feedback voltage from the LED driver.

6. An LED backlight system, comprising:

N LED strings, where N is a positive integer greater than 1; and a driving apparatus, coupled to the LED strings, and configured to receive a dimming signal and time-divisionally generate N control signals by means of purely digital manner in response to a counting clock and an enabling time and a period time both related to the dimming signal, wherein enabling times of the time-divisionally generated N control signals are partially overlapped from each other, and the driving apparatus further respectively controls an on-off time ratio of a current flowing through each of the LED strings by a switching means in response to the control signals.

7. The LED backlight system according to claim 6, wherein the driving apparatus comprises:

an LED driver, configured to receive the dimming signal and time-divisionally generate the control signals in response to the counting clock and the enabling time and the period time both related to the dimming signal; and a switching unit, coupled to the LED driver and the LED strings, and configured to respectively control the on-off time ratio of the current flowing through each of the LED strings in response to the control signals.

8. The LED backlight system according to claim 7, wherein the LED driver comprises:

a first counter, configured to receive the dimming signal and count the dimming signal in response to the counting clock so as to obtain an enabling counting value and a period counting value that respectively represent the enabling time and the period time, wherein a frequency of the counting clock is substantially greater than a frequency of the dimming signal;

a divider, coupled to the first counter, and configured to divide the period counting value by N so as to obtain a delay value;

a pulse signal generator, coupled to the divider, and configured to time-divisionally generate N pulse signals within the period time of the dimming signal in response to the dimming signal, the counting clock and the delay value; and N second counters, coupled to the first counter and the pulse signal generator, and configured to time-divisionally generate the control signals in response to the enabling counting value, the counting clock and the pulse signals.

9. The LED backlight system according to claim 7, wherein the switching unit comprises:

N switches, respectively corresponding to the LED strings and respectively controlling the on-off time ratio of the current flowing through each of the LED strings in response to the control signals.

10. The LED backlight system according to claim 7, wherein the LED strings are operated under a same system voltage, and the driving apparatus further comprises:

a boost-buck unit, configured to receive a DC input voltage and perform a boost-buck process on the DC input voltage by employing a PWM control mechanism so as to generate and output the system voltage.

11. The LED backlight system according to claim 10, wherein the boost-buck unit further steadily outputs the system voltage in response to a feedback voltage from the LED driver.

12. A driving method of an LED backlight system, wherein the LED backlight system has N LED strings, where N is a positive integer greater than 1, and the driving method comprising:

time-divisionally generating N control signals by means of purely digital manner according to a counting clock and an enabling time and a period time both related to a dimming signal, wherein enabling times of the time-divisionally generated N control signals are partially overlapped from each other; and respectively controlling an on-off time ratio of a current flowing through each of the LED strings according to the control signals.

13. The driving method of the LED backlight system according to claim 12, wherein the step of time-divisionally generating the control signals comprises:

counting the dimming signal according to the counting clock so as to obtain an enabling counting value and a period counting value that respectively represent the enabling time and the period time, wherein a frequency of the counting clock is substantially greater than a frequency of the dimming signal;

dividing the period counting value by N so as to obtain a delay value;

time-divisionally generating N pulse signals within the period time of the dimming signal according to the dimming signal, the counting clock and the delay value; and time-divisionally generating the control signals by a counting means according to the enabling counting value, the counting clock and the N pulse signals.

14. The driving method of the LED backlight system according to claim 12, wherein the step of respectively controlling the on-off time ratio of the current flowing through each of the LED strings comprises:

respectively controlling the on-off time ratio of the current flowing through each of the LED strings by a switching means according to the control signals.

15. The driving method of the LED backlight system according to claim 12, wherein the LED strings are operated under a same system voltage, and before the step of time-divisionally generating the control signals, the driving method further comprises:

performing a boost-buck process on a DC input voltage by employing a PWM control mechanism so as to generate the system voltage.

16. The driving method of the LED backlight system according to claim 15, wherein after generating the system voltage, the driving method further comprises:

making the system voltage to be steadily outputted in response to a feedback voltage.

* * * * *